US011872442B1

(12) United States Patent
Cai et al.

(10) Patent No.: US 11,872,442 B1
(45) Date of Patent: Jan. 16, 2024

(54) WATER-MAGNETIC DOUBLE-RESISTANCE ROWING MACHINE

(71) Applicants: Zhejiang Feier Intelligent Technology Co., Ltd., Zhejiang (CN); Xiamen Jindong Technology Co., Ltd., Xiamen (CN)

(72) Inventors: Shaoyuan Cai, Fujian (CN); Bihui Wang, Hunan (CN)

(73) Assignees: XIAMEN JINDONG TECHNOLOGY CO., LTD., Xiamen (CN); ZHEJIANG FEIER INTELLIGENT TECHNOLOGY CO., Zhejiang (CN)

( * ) Notice: Subject to any disclaimer, the term of this patent is extended or adjusted under 35 U.S.C. 154(b) by 0 days.

(21) Appl. No.: 18/327,573

(22) Filed: Jun. 1, 2023

(30) Foreign Application Priority Data

Jul. 21, 2022 (CN) ..... 202221884904.1

(51) Int. Cl.

| | |
|---|---|
| ***A63B 22/00*** | (2006.01) |
| ***A63B 21/00*** | (2006.01) |
| ***A63B 21/008*** | (2006.01) |
| ***A63B 21/22*** | (2006.01) |

(52) U.S. Cl.
CPC ..... *A63B 22/0076* (2013.01); *A63B 21/008* (2013.01); *A63B 21/00192* (2013.01); *A63B 21/153* (2013.01); *A63B 21/22* (2013.01); *A63B 21/4034* (2015.10); *A63B 21/4035* (2015.10); *A63B 2022/0079* (2013.01)

(58) Field of Classification Search
CPC ..... A63B 21/00192; A63B 21/008; A63B 21/0084; A63B 21/15; A63B 21/151; A63B 21/153; A63B 21/22; A63B 21/4033; A63B 21/4034; A63B 21/4035; A63B 21/4045; A63B 21/4049; A63B 22/0076; A63B 22/20; A63B 22/201; A63B 22/203; A63B 2022/0079; A63B 69/06; A63B 2069/062
See application file for complete search history.

(56) References Cited

U.S. PATENT DOCUMENTS

| | | | | |
|---|---|---|---|---|
| 11,071,886 | B1 * | 7/2021 | Scholten | A63B 21/4031 |
| 11,318,343 | B2 | 5/2022 | Hsieh | |
| D961,019 | S * | 8/2022 | Tian | D21/674 |
| 2013/0225375 | A1 * | 8/2013 | Lumsden | A63B 21/0051 482/72 |
| 2017/0209729 | A1 * | 7/2017 | King | A63B 21/4045 |
| 2017/0361153 | A1 * | 12/2017 | Machovina | A63B 21/153 |

(Continued)

FOREIGN PATENT DOCUMENTS

| | | | | |
|---|---|---|---|---|
| CN | 108939492 | A * | 12/2018 | A63B 69/06 |
| CN | 113082591 | A * | 7/2021 | A63B 21/008 |

(Continued)

*Primary Examiner* — Gary D Urbiel Goldner
(74) *Attorney, Agent, or Firm* — Justin Lampel

(57) ABSTRACT

The present utility model provides a water-magnetic double-resistance rowing machine, wherein a pullback device is in transmission connection with a rotating shaft of a damping water tank and a magnetic control wheel simultaneously, and through the cooperation of the damping water tank and the magnetic control wheel, the rowing machine has double resistance of water and magnetism, which can achieve greater exercise intensity.

10 Claims, 4 Drawing Sheets

(56) References Cited

U.S. PATENT DOCUMENTS

| | | | | |
|---|---|---|---|---|
| 2018/0056118 | A1* | 3/2018 | Bates | A63B 21/153 |
| 2018/0272182 | A1* | 9/2018 | Hou | A63B 22/0076 |
| 2019/0099649 | A1* | 4/2019 | Machovina | A63B 69/06 |
| 2019/0118021 | A1* | 4/2019 | Liu | A63B 21/0084 |
| 2020/0282256 | A1 | 9/2020 | Boyles et al. | |
| 2021/0197014 | A1* | 7/2021 | Machovina | A63B 21/157 |
| 2022/0143456 | A1* | 5/2022 | Lammers | A63B 22/0076 |
| 2022/0362624 | A1 | 11/2022 | Dalebout | |
| 2023/0077418 | A1 | 3/2023 | Qiu et al. | |

FOREIGN PATENT DOCUMENTS

| | | | | |
|---|---|---|---|---|
| CN | 215876111 | U | * | 2/2022 |
| CN | 218420845 | U | * | 2/2023 |
| EP | 3403698 | A1 | * | 11/2018 |
| WO | WO-2017133048 | A1 | * | 8/2017 |
| WO | WO-2018145233 | A1 | * | 8/2018 |

* cited by examiner

WATER-MAGNETIC DOUBLE-RESISTANCE ROWING MACHINE

TECHNICAL FIELD

The present utility model relates to the field of fitness equipment, and in particular to a water-magnetic double-resistance rowing machine.

BACKGROUND

Rowing machine generally has water resistance and magnetic resistance form. When people need to increase exercise intensity, people can only increase the resistance of paddling by adding water to a water tank, or increase a magnetic force of a magnetic block to increase the resistance, so as to achieve the purpose of increasing the exercise intensity. However, these single modes make the exercise intensity not greatly improved, and cannot reach greater exercise intensity.

SUMMARY

An objective of the present utility model is to provide a water-magnetic double-resistance rowing machine, which achieves greater exercise intensity through the cooperation of the damping water tank and the magnetic control wheel.

In order to achieve the objective, the present utility model provides the following technical solutions.

According to an aspect of the present utility model, the present utility model provides a water-magnetic double-resistance rowing machine, which comprises: a rack, a damping water tank, a magnetic control wheel, a pullback device, a pull rope, and a handle, wherein a rotating shaft of the damping water tank is vertically disposed, the damping water tank is connected to the rack, a part where the rotating shaft extends into the damping water tank is provided with a paddle, the pullback device forms a transmission connection with the rotating shaft of the damping water tank and the magnetic control wheel simultaneously, one end of the pull rope is wound on the pullback device, and the other end of the pull rope is connected to the handle.

According to some embodiments of the present application, the magnetic control wheel is in transmission connection with the pullback device through a belt.

According to some embodiments of the present application, the pullback device is disposed on a part of the rotating shaft that extends out of the damping water tank.

According to some embodiments of the present application, the rowing machine further comprises a middle support plate, wherein the middle support plate is disposed on the damping water tank, the middle support plate is provided with a through hole for the rotating shaft to pass through, the part of the rotating shaft that extends out of the damping water tank passes through the through hole, the through hole is disposed on one end part of the middle support plate, and the magnetic control wheel is rotatably disposed on the other end part of the middle support plate.

According to some embodiments of the present application, the rack comprises a sliding rail and a seat cushion, and the seat cushion is slidably fitted on the slide rail.

According to some embodiments of the present application, the rack further comprises a mounting frame, the seat cushion is interconnected with the mounting frame, and the magnetic control wheel, the pullback device, and the damping water tank are all mounted in the mounting frame.

According to some embodiments of the present application, both sides of the mounting frame detachably are provided with a first cover plate and a second cover plate.

According to some embodiments of the present application, a sealing plate is further disposed above the mounting frame, the sealing plate, the first cover plate, and the second cover plate form an accommodation space, and the magnetic control wheel, the pullback device, and the damping water tank are all disposed in the accommodation space.

According to some embodiments of the present application, the sealing plate is provided with a handle seat for placing the handle, and the sealing plate is provided with a rope hole for the pull rope to pass through; and the sealing plate is further provided with a fine-tuning knob for tuning a magnetic force of the magnetic control wheel.

According to some embodiments of the present application, the rack is further provided with two pedals, and the two pedals are disposed on both sides of the handle, respectively.

According to the above technical solutions, embodiments of the present utility model at least have the following advantages and beneficial effects:

according to the water-magnetic double-resistance rowing machine in embodiments of the present utility model, the pullback device is in transmission connection with the rotating shaft of the damping water tank and the magnetic control wheel simultaneously, and through the cooperation of the damping water tank and the magnetic control wheel, the rowing machine has double resistance of water and magnetism, which can achieve greater exercise intensity.

Figure 1:
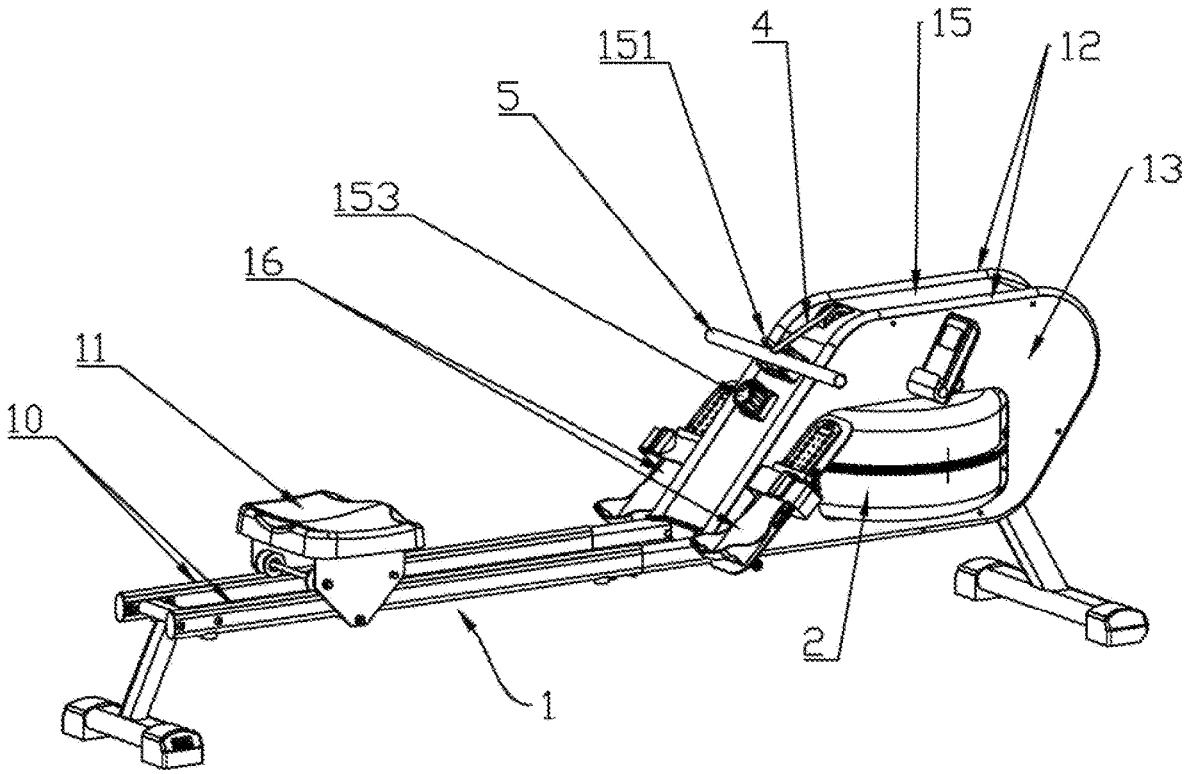
FIG. 1 is a main body diagram of a water-magnetic double-resistance rowing machine.

1—rack; 2—damping water tank; 3—pullback device; 4—pull rope; 5—handle; 6—rotating shaft; 7—magnetic control wheel; 8—middle support plate; 9—through hole; 10—sliding rail; 11—seat cushion; 12—mounting frame; 13—first cover plate; 14—second cover plate; 15—sealing plate; 151—handle seat; 152—rope hole; 153—fine-tuning knob; and 16—pedal.

DETAILED DESCRIPTION OF THE EMBODIMENTS

Although the present utility model can be easily expressed in different forms of embodiments, only some specific embodiments are shown in the drawings and will be described in detail in this specification. At the same time, it can be understood that this specification should be regarded as an exemplary description of the principle of the present utility model, and is not intended to limit the present utility model to what is described here.

Therefore, one feature indicated in this specification will be used to describe one of the features of one embodiment of the present utility model, instead of implying that every embodiment of the present utility model must have the described feature. In addition, it should be noted that this specification describes many features. Although some features may be combined to show a possible system design, these features may also be used in other combinations not explicitly described. Therefore, the described combinations are not intended to be limiting unless otherwise specified.

In the embodiments shown in the drawings, the indications of directions (such as up, down, left, right, front, and rear) are used to explain that the structure and movement of the various elements of the present utility model are not absolute but relative. These descriptions are applicable when the elements are in the positions shown in the drawings. If the description of the positions of these elements is changed, the indications of these directions are changed accordingly.

The preferred embodiments of the present utility model will be further described in detail below in conjunction with the drawings of this specification.

Figure 2:
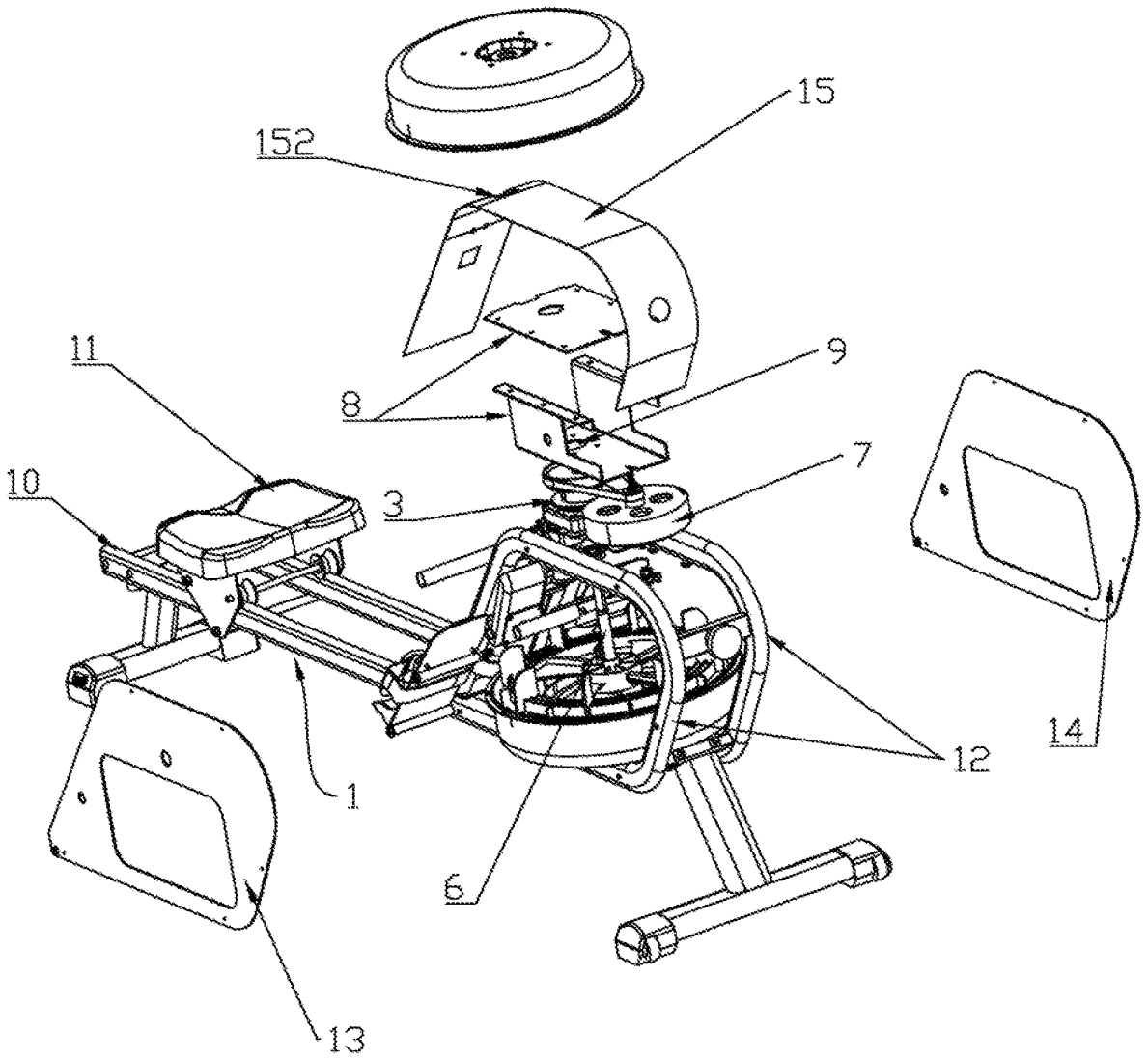
FIG. 2 is an exploded view of a structure of a water-magnetic double-resistance rowing machine.
Figure 3:
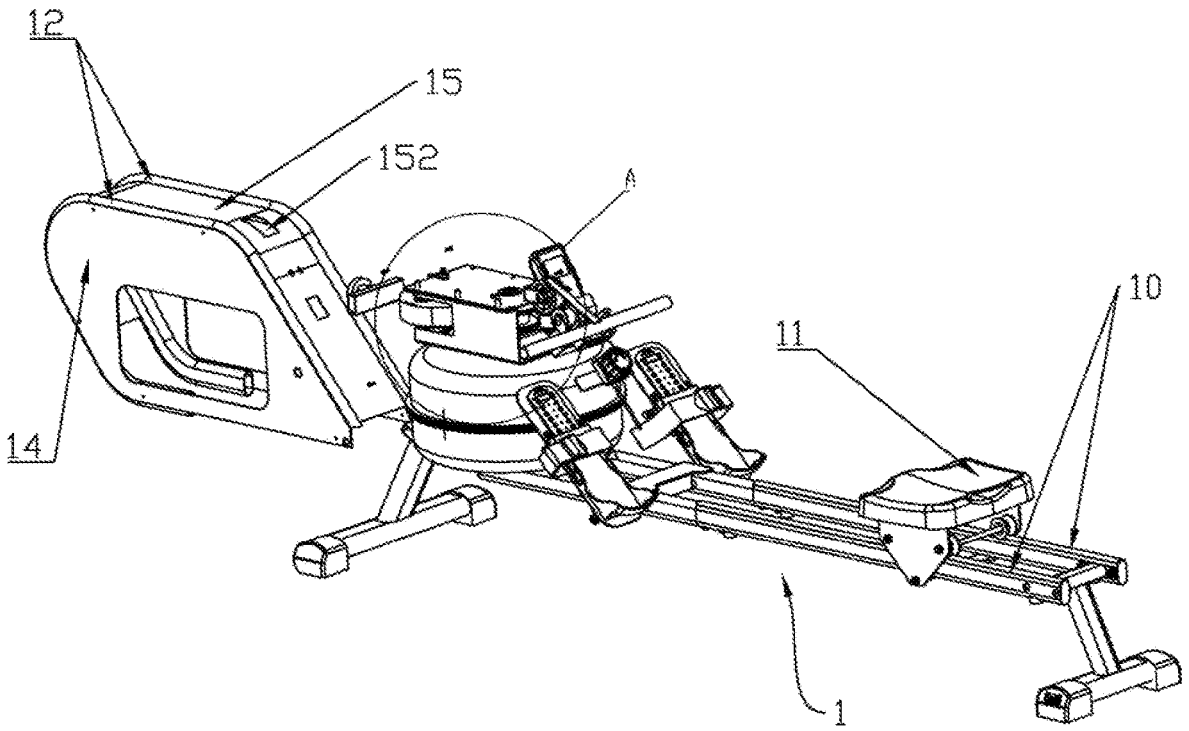
FIG. 3 is an exploded view of structures of a water-magnetic double-resistance rowing machine in different states.
Figure 4:
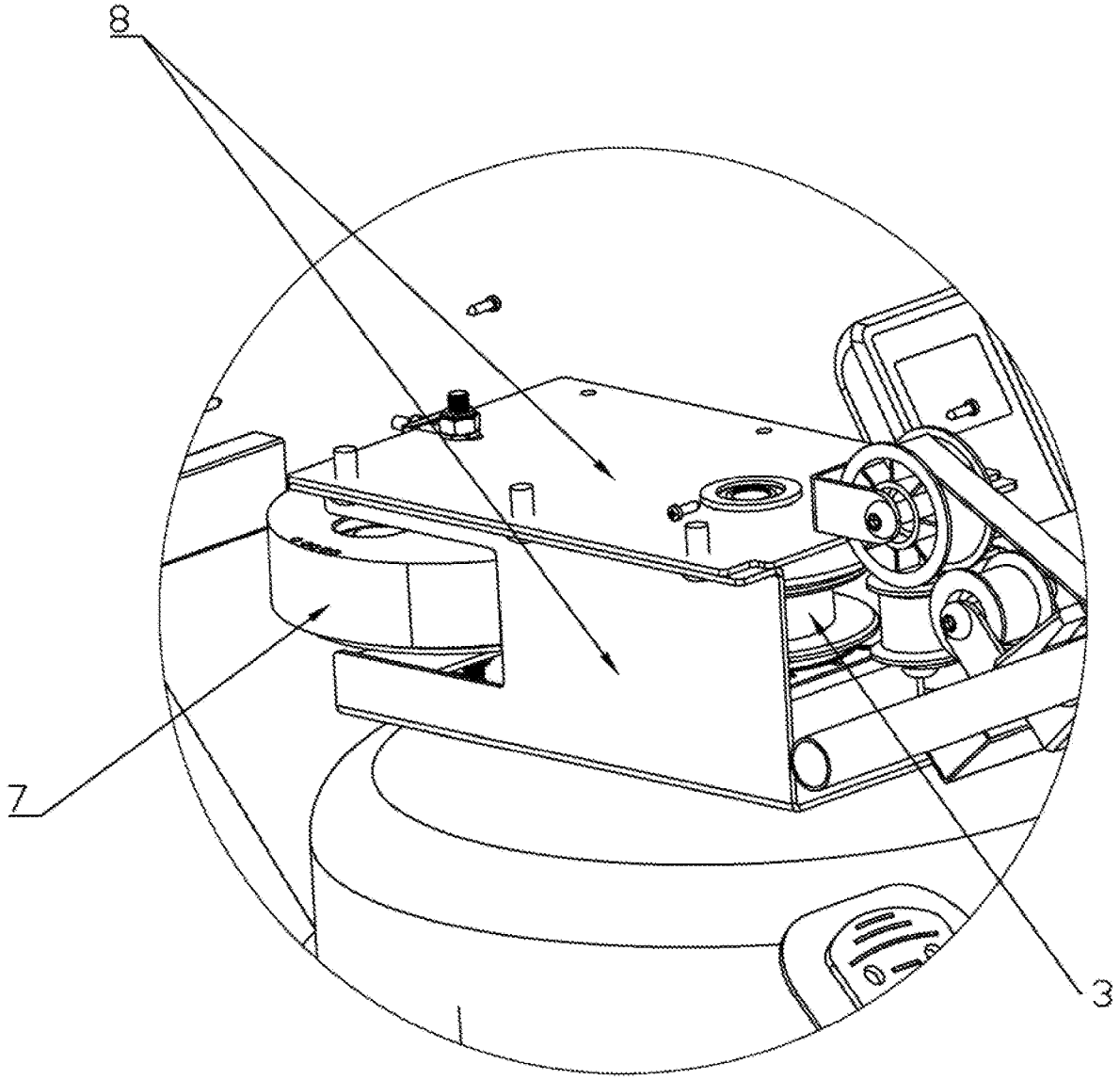
FIG. 4 is an enlarged view of A in FIG. 3.

FIG. 1 is a main body diagram of a water-magnetic double-resistance rowing machine; FIG. 2 is an exploded view of a structure of a water-magnetic double-resistance rowing machine;

FIG. 3 is an exploded view of structures of a water-magnetic double-resistance rowing machine in different states; and FIG. 4 is an enlarged view of A in FIG. 3.

Referring to FIGS. 1 and 2:

Referring mainly to FIGS. 1 and 2, the present utility model provides a water-magnetic double-resistance rowing machine, which comprises: a rack 1, a damping water tank 2, a magnetic control wheel 7, a pullback device 3, a pull rope 4, and a handle 5, wherein a rotating shaft 6 of the damping water tank 2 is vertically disposed, the damping water tank 2 is connected to the rack 1, a part where the rotating shaft 6 extends into the damping water tank 2 is provided with a paddle, the pullback device 3 forms a transmission connection with the rotating shaft 6 of the damping water tank 2 and the magnetic control wheel 7 simultaneously, one end of the pull rope 4 is wound on the pullback device 3, and the other end of the pull rope is connected to the handle 5; through the cooperation of the damping water tank 2 and the magnetic control wheel 7, the rowing machine has double resistance of water and magnetism, which can achieve greater exercise intensity.

Referring mainly to FIG. 2, in some embodiments, the magnetic control wheel 7 is in transmission connection with the pullback device 3 through a belt, and the belt is used as a transmission mode, so that the water-magnetic double-resistance rowing machine is stable in operation and low in noise. The belt has good elasticity, ensures stable transmission in operation, and can buffer and absorb vibration; in addition, the belt further has the characteristics of low cost, simple structure, simple manufacture, no need for lubrication, convenient maintenance, and the like. Apparently, the connection between the magnetic control wheel 7 and the pullback device 3 is achieved not only by the transmission mode of the belt, but also by other transmission modes such as a chain.

In some embodiments, the pullback device 3 is disposed on a part of the rotating shaft 6 that extends out of the damping water tank 2, and the pullback device 3 is directly disposed on the part of the rotating shaft 6 that extends out of the damping water tank 2, so that other complicated and space-consuming transmission structures are omitted, which can save space and facilitate layout.

Referring mainly to FIGS. 3 and 4, in some embodiments, the rowing machine further comprises a middle support plate 8, wherein the middle support plate 8 is disposed on the damping water tank 2, the middle support plate 8 is provided with a through hole 9 for the rotating shaft 6 to pass through, the part of the rotating shaft 6 that extends out of the damping water tank 2 passes through the through hole 9, the through hole 9 is disposed on one end part of the middle support plate 8, and the magnetic control wheel 7 is rotatably disposed on the other end part of the middle support plate 8. The deposition of the middle support plate 8 can be used to lay out the transmission connection between the magnetic control wheel 7 and the pullback device 3, thus forming modularization and facilitating batch mounting. For example, during assembly, the magnetic control wheel 7, the pullback device 3, and other components can be assembled on the middle support plate 8 to form a module; and then the module is assembled on the rotating shaft of the damping water tank 2, so that the rapid mounting is achieved.

In some embodiments, the rack 1 comprises a sliding rail 10 and a seat cushion 11, and the seat cushion 11 is slidably fitted on the slide rail 10. When an operator moves, the operator can sit on the seat cushion 11, and then the seat cushion 11 slides on the slide rail 10, so as to simulate the action of rowing and advancing.

In some embodiments, the rack 1 further comprises a mounting frame 12, the seat cushion 11 is interconnected with the mounting frame 12, and the magnetic control wheel 7, the pullback device 3, and the damping water tank 2 are all mounted in the mounting frame 12. The mounting frame 12 can be used to place the magnetic control wheel 7, the pullback device 3, and the damping water tank 2, so that the layout is aesthetic and reasonable.

In some embodiments, both sides of the mounting frame 12 detachably are provided with a first cover plate 13 and a second cover plate 14, wherein the first cover plate 13 and the second cover plate 14 can shield and protect the magnetic control wheel 7, the pullback device 3, and the damping water tank 2 in the mounting frame 12, so that the appearance of the water-magnetic double-resistance rowing machine is more simple and aesthetic.

In some embodiments, a sealing plate 15 is further disposed above the mounting frame 12, the sealing plate 15, the first cover plate 13, and the second cover plate 14 form an accommodation space, and the magnetic control wheel 7, the pullback device 3, and the damping water tank 2 are all disposed in the accommodation space, so that the appearance of the water-magnetic double-resistance rowing machine is more simple and aesthetic.

In some embodiments, the sealing plate 15 is provided with a handle seat 151 for placing the handle 5, the handle seat 151 can be configured to place the handle 5 to play a role of placing the handle 5, the sealing plate 15 is provided with a rope hole 152 for the pull rope 4 to pass through, and the rope hole 152 facilitates the passing of the pulling rope 4; and the sealing plate 15 is further provided with a fine-tuning knob 153 for tuning a magnetic force of the magnetic control wheel 7, so that an operator can increase or decrease the magnetic force of the magnetic control wheel 7 through the fine-tuning knob 153, so that this rowing machine is suitable for people with different strengths.

In some embodiments, the rack 1 is further provided with two pedals 16, and the two pedals 16 are disposed on both sides of the handle 5, respectively. When an operator moves to simulate rowing, two feet step on the two pedals 16, and the handle is pulled by hands to move, so that the operator feels more like rowing.

According to the above technical solutions, embodiments of the present utility model at least have the following advantages and beneficial effects:

According to the water-magnetic double-resistance rowing machine in embodiments of the present utility model, the pullback device 3 is in transmission connection with the rotating shaft 6 of the damping water tank 2 and the magnetic control wheel 7 simultaneously, and through the cooperation of the damping water tank 2 and the magnetic control wheel 7, the rowing machine has double resistance of water and magnetism, which can achieve greater exercise intensity.

Although the present utility has been described with reference to several exemplary embodiments, it should be understood that the used terms are intended to be illustrative and exemplary rather than limiting. Since the present utility model can be specifically implemented in various forms without departing from the spirit or essence of the present utility model, it should be understood that the above embodiments are not limited by any foregoing details, but should be construed broadly within the spirit and scope as defined in the appended claims. Therefore, all changes and modifications that fall within the scope of the claims or equivalents thereof should be covered by the appended claims.

The invention claimed is:

1. A water-magnetic double-resistance rowing machine, comprising:

a rack, a damping water tank, a magnetic control wheel, a pullback device, a pull rope, and a handle, wherein a rotating shaft of the damping water tank is vertically disposed, the damping water tank is connected to the rack, a part where the rotating shaft extends into the damping water tank is provided with a paddle, the pullback device forms a transmission connection with the rotating shaft of the damping water tank and the magnetic control wheel simultaneously, one end of the pull rope is wound on the pullback device, and another end of the pull rope is connected to the handle;

the water-magnetic double-resistance rowing machine further comprises a middle support plate; the middle support plate comprises an upper plate and a lower plate; the lower plate has a U-shaped cross section; the upper plate and the lower plate form an accommodating chamber configured to accommodate the magnetic control wheel and the pullback device.

2. The water-magnetic double-resistance rowing machine according to claim 1, wherein the magnetic control wheel is in transmission connection with the pullback device through a belt.

3. The water-magnetic double-resistance rowing machine according to claim 1, wherein the pullback device is disposed on a part of the rotating shaft that extends out of the damping water tank.

4. The water-magnetic double-resistance rowing machine according to claim 3, wherein the middle support plate is disposed on the damping water tank, the middle support plate is provided with a through hole for the rotating shaft to pass through, the part of the rotating shaft that extends out of the damping water tank passes through the through hole, the through hole is disposed on one end part of the middle support plate, and the magnetic control wheel is rotatably disposed on another end part of the middle support plate.

5. The water-magnetic double-resistance rowing machine according to claim 1, wherein the rack comprises a sliding rail and a seat cushion, and the seat cushion is slidably fitted on the sliding rail.

6. The water-magnetic double-resistance rowing machine according to claim 5, wherein the rack further comprises a mounting frame, the seat cushion is interconnected with the mounting frame, and the magnetic control wheel, the pullback device, and the damping water tank are all mounted in the mounting frame.

7. The water-magnetic double-resistance rowing machine according to claim 6, wherein two sides of the mounting frame are detachably provided with a first cover plate and a second cover plate, respectively.

8. The water-magnetic double-resistance rowing machine according to claim 7, wherein a sealing plate is further disposed above the mounting frame, the sealing plate, the first cover plate, and the second cover plate form an accommodation space, and the magnetic control wheel, the pullback device, and the damping water tank are all disposed in the accommodation space.

9. The water-magnetic double-resistance rowing machine according to claim 8, wherein the sealing plate is provided with a handle seat for placing the handle, and the sealing plate is provided with a rope hole for the pull rope to pass through; and the sealing plate is further provided with a fine-tuning knob for tuning a magnetic force of the magnetic control wheel.

10. The water-magnetic double-resistance rowing machine according to claim 1, wherein the rack is further provided with two pedals, and the two pedals are disposed on two sides of the handle, respectively.

* * * * *